US006283260B1

(12) United States Patent
Yasuda, Sr.

(10) Patent No.: US 6,283,260 B1
(45) Date of Patent: Sep. 4, 2001

(54) STORAGE DEVICE

(76) Inventor: Kenneth E. Yasuda, Sr., 4178 Linkside Dr., Powder Springs, GA (US) 30127

( * ) Notice: Subject to any disclaimer, the term of this patent is extended or adjusted under 35 U.S.C. 154(b) by 0 days.

(21) Appl. No.: 09/478,121

(22) Filed: Jan. 4, 2000

(51) Int. Cl.[7] ..... A45C 3/12; A45C 11/26

(52) U.S. Cl. ..... 190/102; 190/108; 190/110; 150/111; 150/113; 150/117

(58) Field of Search ..... 190/102, 108, 190/109, 111; 150/117, 111, 113; 206/315.5

(56) References Cited

U.S. PATENT DOCUMENTS

| | | | | |
|---|---|---|---|---|
| D. 227,818 | * | 7/1973 | Dipodova | 190/108 X |
| D. 232,666 | | 9/1974 | Spransy . | |
| 308,418 | | 11/1884 | Lockwood | 383/72 X |
| 451,843 | * | 5/1891 | Powell | 190/102 |
| 688,671 | | 12/1901 | Nason | 383/71 |
| 1,096,537 | | 5/1914 | Humphreys | 383/61 |
| 1,148,924 | | 8/1915 | Paradise | 383/71 |
| 1,176,598 | * | 3/1916 | Pollgreen | 190/111 |
| 1,214,282 | | 1/1917 | Day | 224/236 X |
| 1,727,954 | | 9/1929 | Beehler | 190/102 X |
| 1,824,508 | | 9/1931 | Shipman | 383/86 |
| 2,319,729 | * | 5/1943 | Ford | 190/102 |
| 2,407,787 | | 9/1946 | Kernahan | 224/236 X |
| 2,574,786 | | 11/1951 | Hiatt . | |
| 2,707,035 | | 4/1955 | Lashley | 190/108 X |
| 2,737,221 | | 3/1956 | Knox | 383/86 X |
| 2,813,602 | * | 11/1957 | MacArthur, Jr. | 190/108 X |
| 2,979,098 | | 4/1961 | Greaves . | |
| 3,225,806 | | 12/1965 | Pollak et al. | 383/61 X |
| 3,729,038 | | 4/1973 | Ekeson | 190/110 X |
| 3,837,447 | * | 9/1974 | Honan | 190/108 X |
| 4,598,803 | | 7/1986 | Ghiassi . | |
| 4,640,392 | * | 2/1987 | Decker, Jr. et al. | 190/102 X |
| 4,685,546 | * | 8/1987 | Sadow | 190/102 |
| 4,955,516 | | 9/1990 | Satterfield . | |
| 4,974,709 | | 12/1990 | Furlow et al. . | |
| 5,096,059 | * | 3/1992 | Henderson | 206/315.5 |
| 5,354,131 | * | 10/1994 | Mogil | 189/102 X |
| 5,520,462 | * | 5/1996 | Clark | 190/102 X |
| 5,947,241 | * | 9/1999 | Rausch | 190/102 X |
| 6,012,557 | * | 1/2000 | Derelanko | 190/102 X |

FOREIGN PATENT DOCUMENTS

| | | | |
|---|---|---|---|
| 500121 | 2/1954 | (CA) | 224/269 |
| 1195440 | 11/1959 | (FR) . | |
| 1237028 | 6/1960 | (FR) | 190/102 |
| 2358124 | 2/1978 | (FR) | 190/102 |
| 382924 | 11/1932 | (GB) | 190/102 |
| 396926 | 9/1933 | (GB) | 190/102 |
| 1456176 | 11/1976 | (GB) . | |
| 1458044 * | 12/1976 | (GB) | 190/102 |
| 2257028 * | 1/1993 | (GB) | 190/102 |

OTHER PUBLICATIONS

International Search Report for PCT/US01/00209, European Patent Office.

* cited by examiner

*Primary Examiner*—Sue A. Weaver
(74) *Attorney, Agent, or Firm*—Kristin D. Mallatt; Bruce D. Gray; Kilpatrick Stockton LLP

(57) ABSTRACT

The present invention relates to a storage device for use with a carrying case, and having an aperture therein adapted to receive a handle or strap of the carrying case. The device may also have attachment devices enabling the device to be carried separate from the carrying case if desired. Side body portions of the device have compartments that are adapted to receive, store, and carry items of various sizes. These compartments may be lined with material to protect or enhance the items contained therein. Optional straps may extend from the bottom edges of the side portions in order to attach and secure the device onto a carrying case.

8 Claims, 7 Drawing Sheets

STORAGE DEVICE

FIELD OF THE INVENTION

The present invention relates to a storage device that may be used with a carrying case, such as a briefcase, suitcase, purse, or golf bag. The storage device fits over a handle or strap of the carrying case in order to hold various personal items, such as shoes, diapers, newspapers, umbrellas, or other personal items. If desired, the storage device may be adapted to be carried separately from the carrying case.

BACKGROUND OF THE INVENTION

Many people who travel or commute to and from work need to carry personal items that are too bulky or are otherwise not suitable to be carried inside a traditional carrying case. Even items capable of fitting inside a carrying case may need to be more easily accessible. For example, many people commute to work by walking some distance, and so wear jogging, tennis, or walking shoes while carrying their dress shoes or work shoes. These shoes are often shoved into purses or attache cases, or carried in the person's hand. All of these methods are both inconvenient and risk soiling the contents of the person's carrying case or clothing.

Additionally, people may wish to carry and have easy access to an umbrella, a newspaper, or similar items while traveling or commuting. There is a need for a satisfactory way to carry shoes and other items, while allowing easy access to all of these items and separating them so as to prevent them from scuffing or otherwise damaging each other or other objects.

Carrying dress shoes in a paper or plastic bag is not a desirable alternative because the shoes are not protected. They may become easily scuffed or scratched because they are not separated from one another. Bags also rip, get holes in them, and are hard to carry. As a result, the shoes are more subject to rain damage, being splashed, or being dropped. Paper or plastic bags also fail to provide a compartment for holding (and keeping accessible) additional personal items such as newspapers, books, maps, reading material, keys, cellular phones, organizers, hand-held computers, bottled water, or other items.

Storage or carrying devices intended to be used in connection with carrying cases are known in the art, but they have various shortcomings. Many of these devices comprise separate compartments that are connected by straps that fit underneath a handle of the carrying case. This results in complicated and inconvenient fastening or attachment procedures. Additionally, many devices are insufficiently secured to the carrying case. Without an attachment component available to secure the device in place over a carrying case, the device slides back and forth over the case, causing damage to the case and irritating the user. A number of these devices also have large, bulky compartments or are only intended to hang on one side of a briefcase. There is therefore a need in the art for a storage device that can easily and conveniently fit over a handle of a carrying case, and that is capable of storing several items separately.

There is also a need for a device that may be used with a carrying case to separate, store, and transport baby accessories, such as diapers, bottles, blankets, pacifiers, etc. Instead of carrying both a purse and a diaper bag or simply a diaper bag with personal items contained therein, it would be desirable to be able to carry a purse, handbag, or other carrying case with a separate diaper storage device so that both can easily be handled with one hand, leaving the other hand free to push a baby stroller, carry a baby, etc.

It is also desirable to have an optional attachment devices for such a device, whereby the device may also be carried alone. For example, a male using the device to transport baby accessories would not carry a purse and would not necessarily carry a briefcase on weekends, but may still wish to use the device. Thus, it is desirable for the device to be capable of being carried separate from a carrying case.

In view of these needs in the art, one advantage of the present invention is that it provides a storage device that cooperates with a carrying case and that provides separate compartments for storage of multiple items. These compartments may be used to store and carry various items, for example, shoes, baby accessories, newspapers, books, maps, other reading material, umbrellas, keys, cellular phones, organizers, hand-held computers, bottled water, or other personal items.

Another advantage of a particular embodiment of this invention is that it provides a storage device having at least two separate compartments. In a more particular embodiment of the invention, the compartments are lined.

Another advantage of a particular embodiment of this invention is that it provides a storage device having a separate compartment for reading material or other personal items, which is thin, flat, and easily held next to the body.

Another advantage of a particular embodiment of this invention is that it provides a storage device with compartments that are adapted to hold particular items, such as shoes, thereby storing and keeping a pair of shoes separated during transport.

Another advantage of a particular version of this embodiment is that it provides a storage device with separate compartments for carrying shoes, the compartments being lined with buffing or satin material so that the shoes will self-buff through the jostling action and movement of the person carrying the device.

Yet another advantage of a particular version of this embodiment is that it provides a storage device that may be used with a carrying case to separate, store, and transport baby accessories, such as diapers, bottles, pacifiers, blankets, etc.

Another advantage of a particular version of this embodiment is that it provides a storage device that has separate lined compartments to store and carry diapers, keeping clean and soiled diapers separate.

Another advantage of a particular embodiment of this invention is that it provides a storage device in which end straps may be connected underneath or around a carrying case in order to secure the device and to eliminate any sliding motion of the device on the carrying case.

Another advantage of a particular embodiment of this invention is that it provides a storage device that has at least one additional removable carrying compartment.

Yet another advantage of a particular embodiment of this invention is that it provides a storage device for shoes or other golfing accessories, such as golf tees, golf balls, a golf glove, etc. that may be attached to a golf bag.

Another advantage of a particular embodiment of this invention is that it provides a storage device having attachment devices that enable a carrying strap, such as a shoulder strap, to be fastened to the device. This enables the user to carry the device separate from a carrying case.

SUMMARY OF THE INVENTION

This invention relates to a storage device that may be used with a carrying case. The storage device has an aperture that allows it to be placed over a handle or strap of the carrying case, which enables both the carrying case and attached storage device to be easily carried without the need to use both hands. The storage device is formed from a base sheet of material having a connecting portion between two body portions. The connecting portion has an aperture that is adapted to receive the handle of a carrying case. When the storage device is placed over a carrying case, the handle of the carrying case extends through the aperture and may be grasped by a person using the case. This enables a user to lift and carry the carrying case and the storage device at the same time using only one hand.

The device may also have optional attachment devices that may be used in conjunction with a carrying strap, preferably an adjustable shoulder strap, enabling the device to be carried when the user is not carrying a separate carrying case.

When carried with a carrying case, the body portions of the storage device extend down opposite sides of the carrying case. The body portions may be any shape, such as trapezoidal, rectangular, square, triangular, rounded, etc. In particular embodiments, the body portions of the storage device may have a number of pockets or compartments for storing items that may otherwise be difficult or inconvenient to store or carry, in particular for someone who is traveling or commuting. The pockets or compartments are easily accessible, and in a more particular embodiment, may be lined with certain materials to ensure protection or enhancement of the items contained therein. For example, the lining may be a buffing material, such as a soft fabric or cloth of the type typically used for buffing or shining shoes, or a soft satin fabric to protect shoes or other items. Alternatively, the lining may be a moisture-resistant, stain-resistant material such as plastic.

In another embodiment of the invention, at least one of the body portions of the storage device lies substantially flat, so that when the storage device is carried together with a carrying case, it can be held close to the body. This alleviates the inconvenience of carrying a bulky device that continuously brushes and bumps against the user's legs. This flat body portion may have a pocket or multiple compartments which can hold items that are also substantially flat or relatively small. It may also be lined to ensure protection of the items contained therein.

In another particular embodiment of this invention, straps may be located at the bottom ends of the body portions. The straps may have attachment components, which help secure the device in place over a carrying case and keep the device from sliding back and forth over the case while being carried.

In another particular embodiment of this invention, the device has attachment devices on its sides which allow it to be carried with a carrying strap, such as a shoulder strap, instead of in conjunction with a carrying case.

DETAILED DESCRIPTION OF SPECIFIC EMBODIMENTS OF THE INVENTION

The storage device of the present invention may be carried with any type of carrying case, such as a briefcase, a purse, a suitcase, a golf bag, or any other type of carrying case with a handle or strap, or may alternatively be carried alone using a separate carrying strap. It may be manufactured out of any type of material. Non-limiting examples include canvas, nylon, polyester, or other woven or non-woven textile or cloth, any similar fabric-type material, plastic, or leather. In one embodiment of the invention, the material of the storage device itself is waterproof, or has been treated with waterproofing agent or stain-resistant accent in order to protect the material itself and the items contained therein.

The device can be made using techniques well known to those of skill in the art and who have reviewed the present specification, e.g., by designing a pattern which will allow the fabric to be cut into appropriate sized pieces and sewn together. The sewn portions may be finished with piping or other decorative elements to give the device a more finished appearance.

Figure 1A:
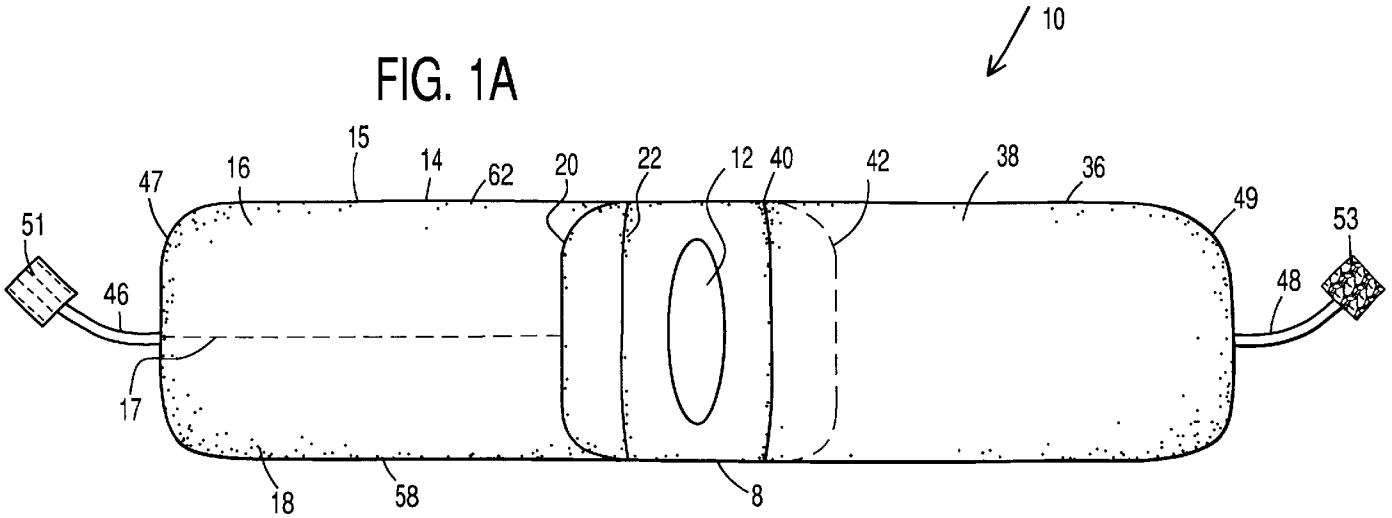
FIG. 1A is a top plan view of a particular embodiment of the storage device of the present invention.
Figure 2A:
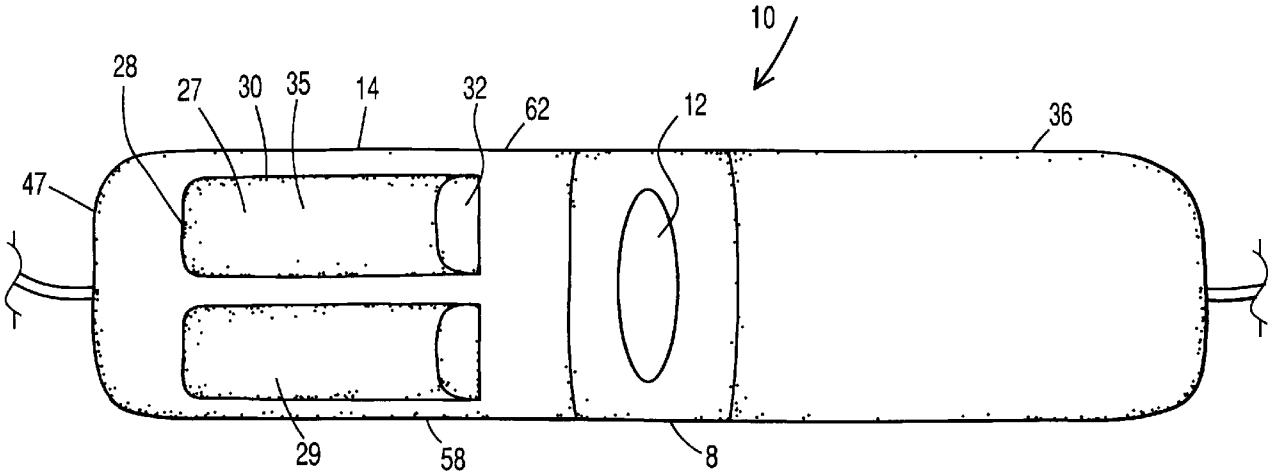
FIG. 2A is a top plan view of an alternative embodiment the storage device, having two separate compartment pockets on the first body portion.

As shown in FIGS. 1A and 2A, storage device 10 comprises base sheet 8 having aperture 12 that is adapted to receive a handle or strap of a carrying case. Aperture 12 is located in the longitudinal center of base sheet 8, but may be located anywhere on base sheet 8. Aperture 12 may be any shape, including without limitation, round, ovoid, square, or rectangular, so long as the opening is suitably sized and has dimensions appropriate to receive a handle of a carrying case.

Figure 3:
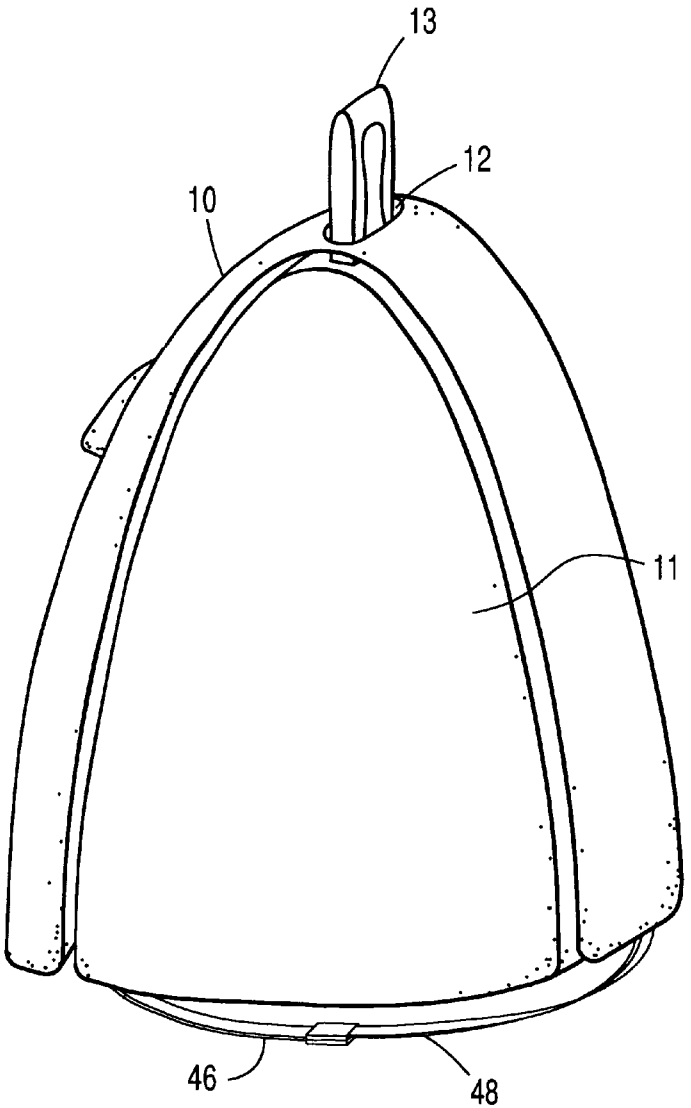
FIG. 3 is a side view showing the embodiment of FIG. 1A attached to a carrying case.

As shown in FIG. 3, when storage device 10 is placed over carrying case 11, handle 13 of carrying case 11 extends through aperture 12 and may be grasped by a person using the case. This allows the user to carry case 11 and device 10 with only one hand. FIG. 3 shows an exemplary type of carrying case that may be used with the storage device, and is not intended to limit the invention in any way.

Figure 4:
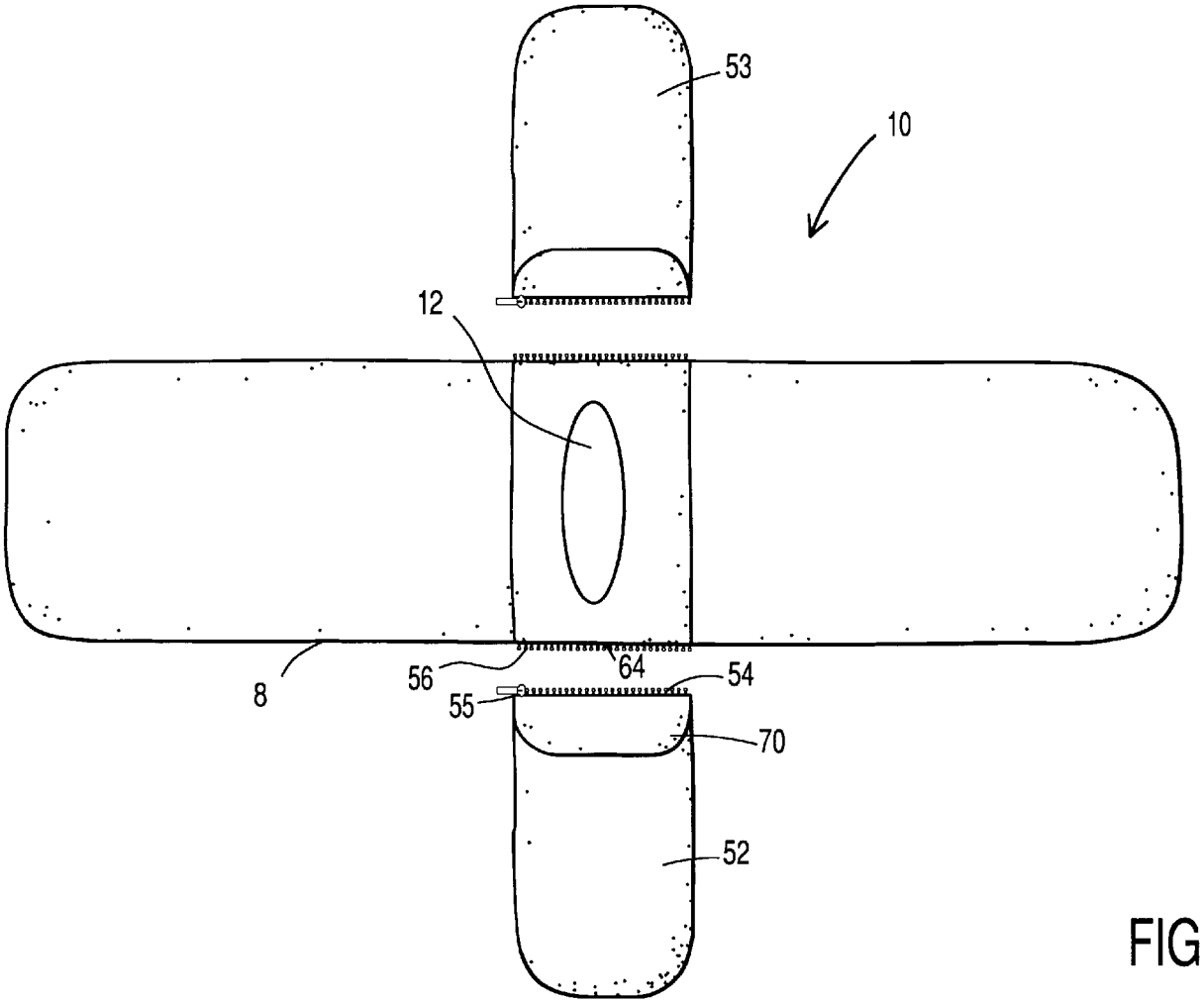
FIG. 4 is a top plan view of an alternative embodiment of the present invention, having side bags that may be zippered or otherwise attached to the storage device.

FIG. 4 shows an additional embodiment of the invention having removable bags 52, 53 for storing additional items. Bags 52, 53 are attached to device 10 at edge 64, which borders aperture 12.

Figure 5:
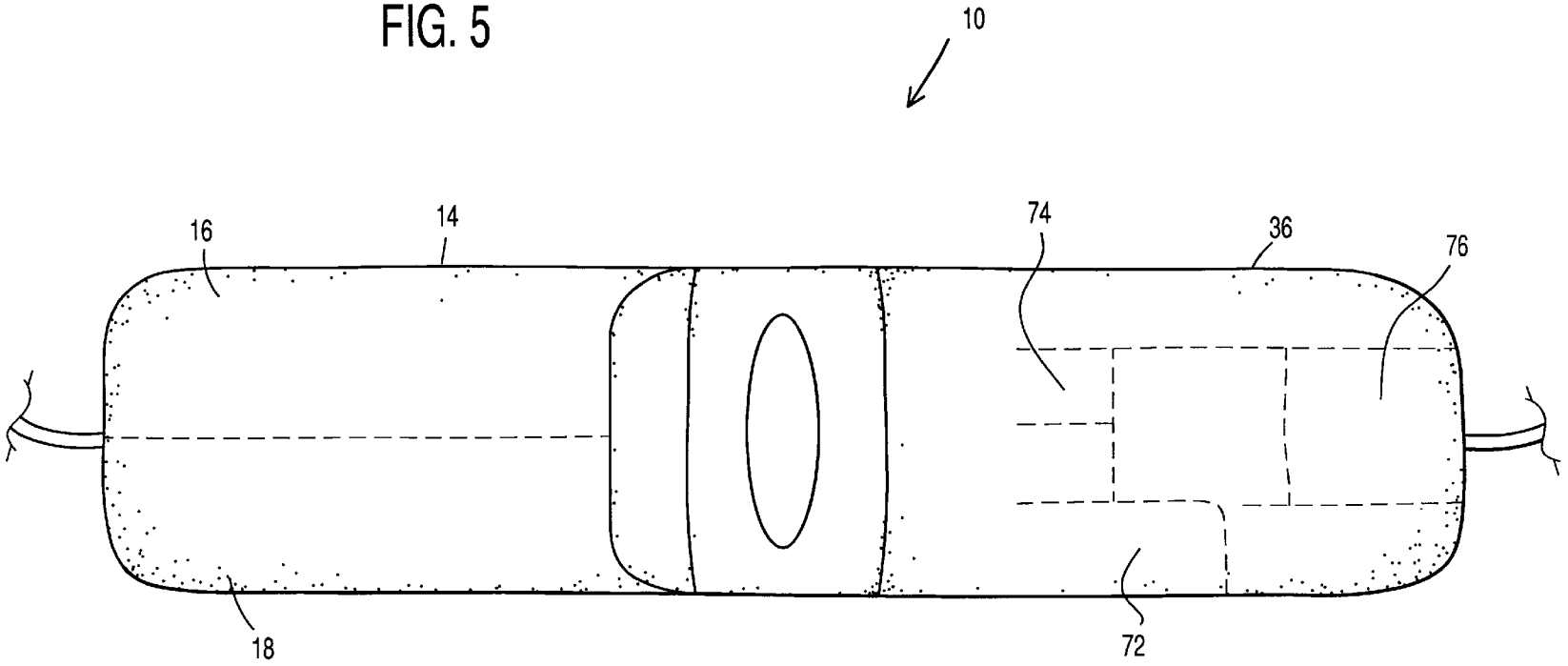
FIG. 5 is a top plan view of an alternative embodiment of the present invention, which is a storage device fashioned to be a diaper bag-like storage device.

FIG. 5 shows an embodiment of the invention that is adapted for use as a modified diaper bag.

Figure 7:
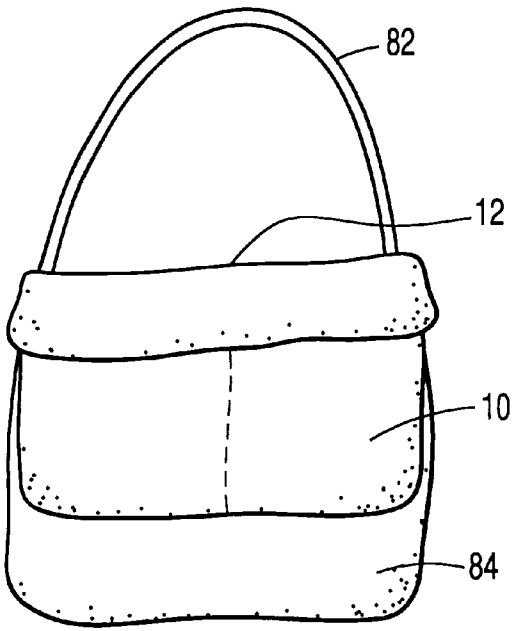
FIG. 7 is a side view of an alternate embodiment of the present invention, used with a purse.
Figure 6:
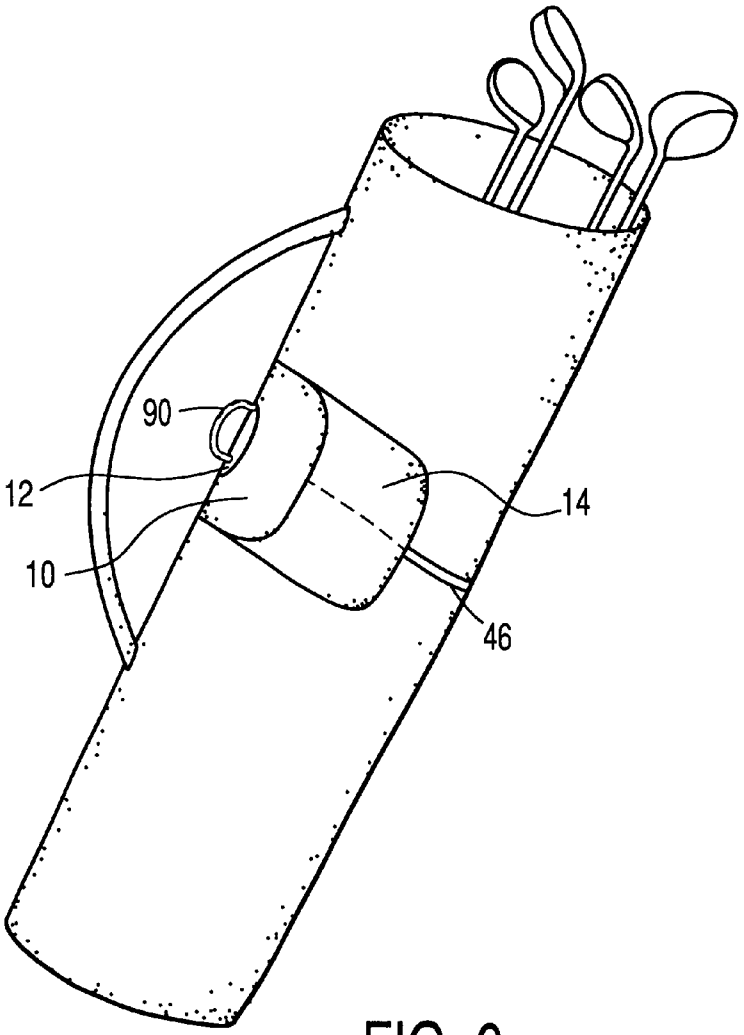
FIG. 6 is a side view of an alternate embodiment of the present invention, used in conjunction with a golf bag.

FIGS. 6 and 7 further illustrate additional non-limiting examples of carrying cases that may be used with the present invention. For example, storage device 10 may fit over a carrying handle on a golf bag, or as shown in FIG. 6, the golf bag may have an attachment 90 on which aperture 12 of device 10 rests. The compartments of device 10 wrap around the golf bag and may be attached together by straps.

Additionally, instead of handle 13 extending through aperture 12 as shown in FIG. 3, strap 82 of purse 84 may fit through aperture 12, as shown in FIG. 7. Device 10 and purse 84 may be carried together by lifting strap 82. It is possible to manufacture several versions of device 10 that have apertures and compartments of various lengths in order to accommodate various purse shapes and sizes.

Figure 8:
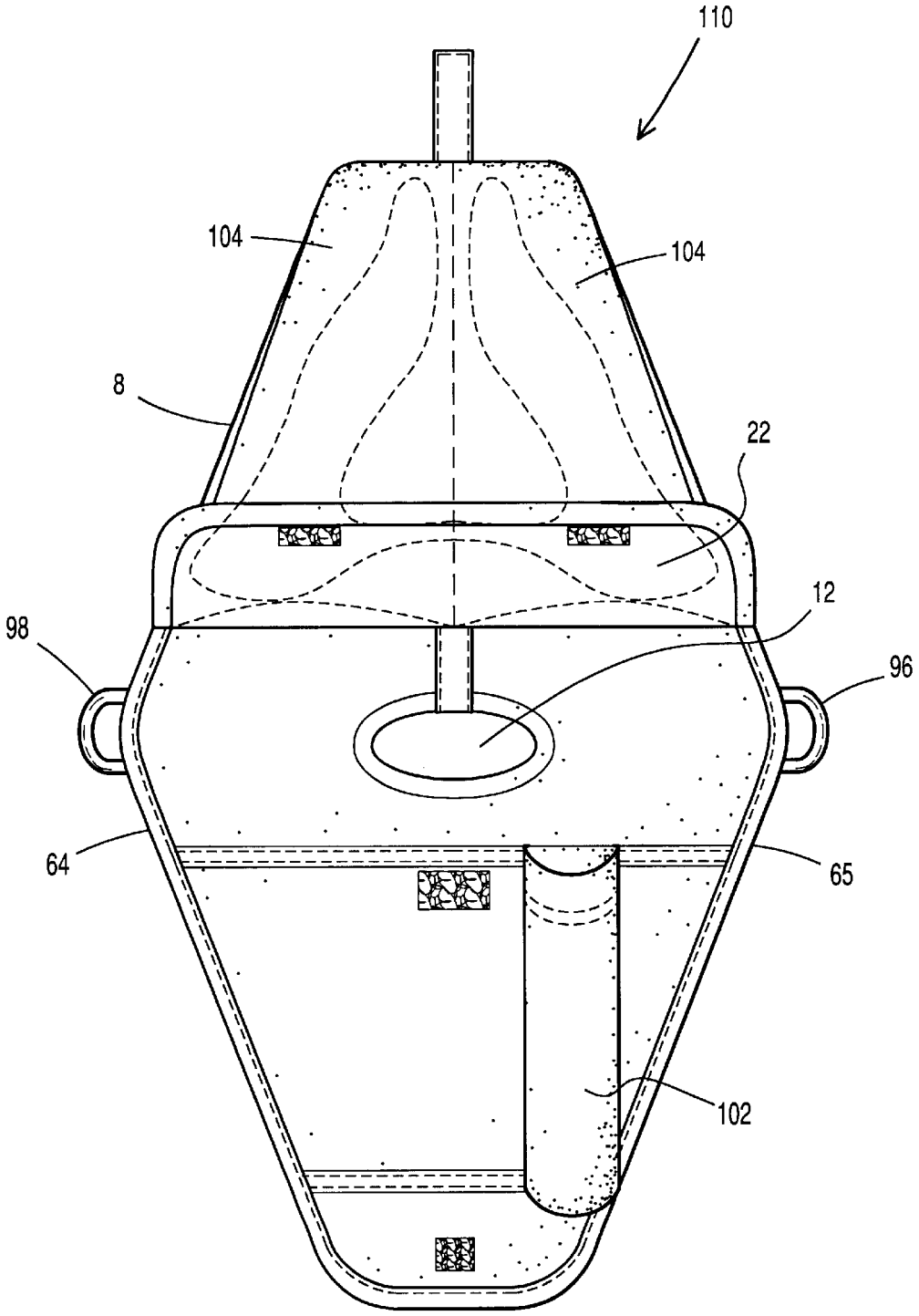
FIG. 8 is a top plan view of an alternate embodiment of the present invention, having attachment devices that enable the storage device to be carried separate from a carrying case.

FIG. 8 shows an embodiment of the invention that is adapted to also be carried separate from a carrying case.

Now addressing the details of the invention, FIG. 1A shows a particular embodiment of the invention having two side body portions 14, 36 that extend from both sides of aperture 12 and comprise a substantial portion of base sheet 8. The body portions may be any shape, such as trapezoidal, rectangular, square, triangular, rounded, etc. First side body portion 14 has two compartment pockets 16, 18. In one embodiment, side body portion 14 comprises large pocket 15 that is divided into two smaller compartment pockets 16, 18 that may be used for containing or storing items. Pocket 15 may be reinforced as necessary. Compartment pockets 16, 18 may be formed by stitch 17 down the middle of large pocket 15.

Figure 1C:
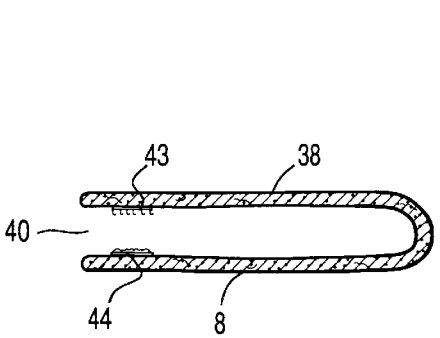
FIG. 1C is a side view in cross-section of a second body portion of the storage device of FIG. 1A, showing a particular embodiment for closure of the pocket-type compartment.
Figure 1B:
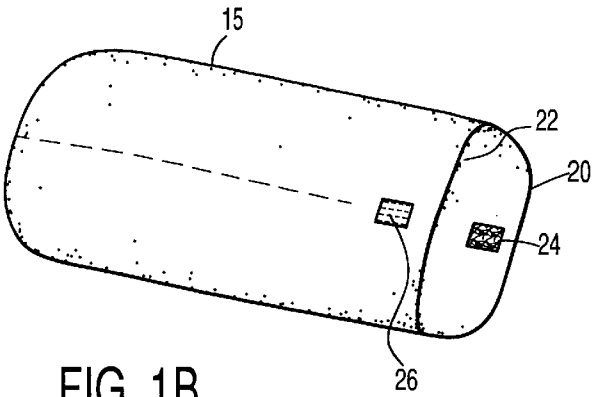
FIG. 1B is a top plan view of a first body portion of the storage device of FIG. 1A, with an open flap.

As shown in FIG. 1A and 1B, flap 20 is connected to base sheet 8 at opening 22 of pocket 15. Flap 20 extends over opening 22 of large pocket 15. Securing of flap 20 to close opening 22 of pocket 15 may be accomplished by hook-and-latch, i.e., a piece of VELCRO 24 positioned on the underside portion of flap 20, and a corresponding piece of hook-and-latch, i.e., a piece of VELCRO 26 positioned on pocket 15, as shown in FIG. 1B. Securing of flap 20 may also be accomplished by snaps, a button and corresponding button hole, male and female connectors, magnetic strips, buckles, zippers, or any other components that enable closure with easy access to compartment pockets 16, 18. It is also possible to for flap 20 to cover opening 22 without a component for securing flap 20 in place.

Figure 2B:
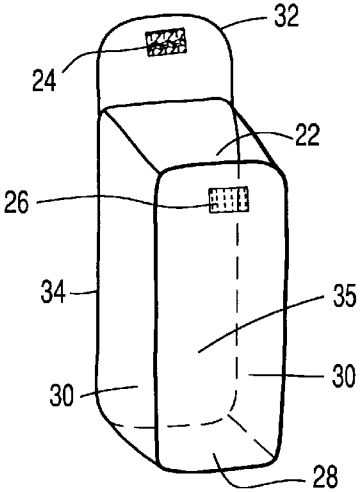
FIG. 2B is a perspective view of one embodiment of a compartment pocket.

Alternatively, FIG. 2A shows an embodiment in which side body portion 14 has two separate compartment pockets 27, 29. Each compartment pocket may have individual bottom 28, sides 30, top flap 32, back portion 34, and front portion 35 as shown in detail in FIG. 2B. In this embodiment, compartment pockets 27, 29 may be formed separately and then stitched or otherwise attached onto base sheet 8. For example, it may be possible to attach pockets 27, 29 to base sheet 8 with a hook-and-latch attachment, allowing pockets to be removable. Top flap 32 extends from back portion 34 of each compartment pocket 27, 29. Securing of flap 32 to close opening 22 may be accomplished by hook-and-latch, i.e., a piece of VELCRO 24 positioned on the underside portion of flap 32, and a corresponding piece of hook-and-latch, i.e., a piece of VELCRO 26 positioned on front portion 35, as shown in FIG. 2B. Securing of flap 32 may also be accomplished by snaps, a button and corresponding button hole, male and female connectors, magnetic strips, buckles, zippers, or any other components that enable closure with easy access to compartment pockets 27, 29. It is also possible to for flap 32 to cover opening 22 without a component for securing flap 32 in place.

In another embodiment of the invention, compartment pockets 16, 18, 27, 29 are not closed with a flap 20 or 32, but instead have an expandable opening. More particularly, the expandable opening may be comprised of a cord or similar article that is embedded into the pocket edges surrounding opening 22, which when pulled or secured, closes opening 22. In this embodiment, flap 20 or 32 is not necessary for closure, but may nevertheless be present for increased security or to protect the pocket opening or closure device from the elements, etc.

Furthermore, compartments pockets 16 and 18 of FIG. 1A or compartment pockets 27 and 29 of FIG. 2A may be at least partially hidden from view by a sheet of material. The sheet of material may be comprised of the materials discussed above and may be attached at bottom end 47, shown in FIG. 1A and at side edges 58, 62 of each side body portion, shown in FIGS. 1A and 2A. Additionally, compartment pockets 16, 18, 27, 29 may be extendible or compressible in order to receive various sized items.

In the alternative, instead of having back portion 34, the backs of compartment pockets 27, 29 may be formed by base sheet 8. Bottom 28 and sides 30 may be formed and stitched onto base sheet 8, with base sheet 8 forming the back of each compartment pocket 27, 29. Top flap 32 may then be secured to base sheet 8 at opening 22. Additionally, bottom 28 and sides 30 may also be reinforced to provide extra support.

One or more of compartments 16, 18, 27, 29 may be lined with certain types of material that will protect or enhance the items contained therein. For instance, if compartments 16, 18, 27, 29 are used to store and carry shoes, they may be lined with buffing or shoe-shining material which will allow the shoes to self-buff through the jostling action that is a natural result from movement of the user. The buffing material may also be removable or replaceable.

One or more of compartments 16, 18, 27, 29 may alternatively or additionally be lined with moisture-resistant, stain-resistant material, such as plastic. This would further protect the contents of compartments 16, 18, 27, 29, as well as device 10 itself from stain and water damage. Additionally, this embodiment enables device 10 to be used as a modified diaper bag. It alleviates the need for using a diaper bag instead of a purse or the need to change back and forth between a purse and a diaper bag. Clean diapers could be placed in one or more compartment pockets 16, 18, 27, 29 and soiled diapers in others. This embodiment may also have compartment pockets for additional baby accessories, as shown in FIG. 5 and as will be described in more detail below.

FIGS. 1A and 2A illustrate compartments 16 and 18, and compartments 27 and 29 respectively, each oriented so that the length of the compartment is perpendicular to handle 13 of carrying case 11 if storage device 10 is placed over carrying case 11, as shown in FIG. 3. Essentially, compartments 16, 18, 27, 29 are vertical if storage device 10 is placed over an upright carrying case 11 as indicated in FIG. 3. To further illustrate this point, in FIG. 1A, compartments 16 and 18 are oriented so that opening 22 of pocket 15 is perpendicular to the length of compartments 16, 18 and parallel to the length of aperture 12.

Alternatively, compartments 16, 18 (or 27, 29) may be positioned in a direction that is parallel to handle 13 of carrying case 11 if storage device 10 is placed over carrying case 11 as shown in FIG. 3. In this embodiment, compartments 16, 18, 27, 29 are oriented so that their length is parallel to aperture 12 (and horizontal if storage device 10 is placed over an upright carrying case 11). Flaps 20, 32 may be located at one or both side edges 58, 62 of first side body portion 14 in order to close compartments 16, 18, 27, 29.

Those of skill in the art will recognize that these examples of pocket orientation with respect to the remainder of the device are illustrative only, that many other arrangements and orientations are possible, and that all of these are within the scope of the invention.

As shown in FIGS. 1A and 2A, second side body portion 36 extends opposite from first body portion 14. Second side body portion 36 may have pocket-type compartment 38, shown in FIG. 1A, that may span the entire second body portion 36 or that may be divided into separate smaller compartments, shown in FIG. 5. Compartment 38 of second side body portion 36 may be lined or coated with plastic or another type of stain-repellent material to ensure that newspaper print, pen leaks, etc. do not damage device 10. Alternatively, second side body portion 36 may be a reinforced portion of base sheet 8 without pockets or compartments, as shown in FIG. 2A.

In a particular embodiment, shown, e.g., in FIG. 1A, compartment 38 lies substantially flat along base sheet 8 so that storage device 10 carried along with a carrying case may be held close to the body. This allows a user to carry substantially flat items, such as newspapers, books, maps, airline tickets, itineraries, glasses, keys, and the like in compartment 38, while holding carrying case and attached device 10 close to the body, thus alleviating a bulky compartment that brushes against the user's legs and interferes with walking.

As illustrated in FIGS. 1A and 1C, compartment 38 has opening 40. This opening may be closed by flap 42 extending over opening 40, shown in phantom on FIG. 1A. Closure may be accomplished as described above for flap 20. Alternatively, as shown in FIG. 1C, compartment 38 may have closure component 43 (for example, a piece of hook-and-latch material, i.e., VELCRO, but the closure component could also comprise those described for securing flap 20 above) located proximate to opening 40 on the inside of compartment 38. Base sheet 8 has corresponding closure component 44, as shown in FIG. 1C.

FIG. 1A also illustrates optional straps 46, 48 that extend from bottom ends 47, 49 of each side body portion 14, 36. Straps 46, 48 are associated with attachment components 51, 53 which attach to each other, allowing straps 46, 48 to form a single strap. Attachment of straps 46, 48 into a single strap secures device 10 over a carrying case and helps device 10 to lie substantially flat alongside the case.

FIG. 3 illustrates straps 46, 48 fastened underneath case 11. Alternatively, straps 46, 48 may be fastened around the sides of a case. In a particular embodiment, each strap 46, 48 has a hook-and-latch, i.e., VELCRO attached to its end. Straps 46, 48 may be adjustable, and attachment components 51, 53 may comprise the attachment components described above for flap 20.

FIG. 4 shows an alternate embodiment of the invention having additional removable bags 52, 53 that may be attached to device 10. Because removable bags 52 and 53 are substantially similar in shape and features, a detailed description of removable bag 52 follows, but it should be noted that corresponding elements exist for removable bag 53. Removable bag 52 may have flap 70 secured with the securing mechanisms discussed above for flap 20. Removable bag 52 has attachment component 54 located at top portion 55 of removable bag 52. Device 10 has a corresponding attachment component 56 located on attaching edge 64. Attaching edge 64 is located on the edge of base sheet 8 that borders aperture 12. Attachment devices 54, 56 may be zippers, snaps, a button and corresponding button hole, male and female connectors, magnetic strips, buckles, or any other attachment device. When removable bag 52 and additional similar removable bag 53 are attached to device 10 and device 10 is placed over a carrying case, removable bags 52 and 53 extend over opposite edges of the case.

An additional embodiment of the present invention shown in FIG. 5 is device 10 adapted for use as a diaper bag. At least one compartment pocket 16, 18 (or 27, 29, shown in FIG. 2A) of first side body compartment 14 is lined with moisture-resistant, stain-resistant material, such as plastic. Second side body portion 36 may comprise a single compartment, or may comprise multiple compartments of various numbers and sizes, examples of which are shown in FIG. 5 as compartments 72, 74, and 76. By way of non-limiting example, compartment 72 may be adapted to receive a bottle, compartment 74 may be adapted to receive a pacifier, compartment 76 may be adapted to receive a blanket. Compartments 72, 74, 76 may all have closure devices as described above. Compartments 72, 74, 76 may be accessible directly from the outside or may be accessed from the inside of side body portion 36. In other words, compartments 72, 74, 76 may or not be visible from the outside and may be at least partially hidden from view by the sheet of material as described above.

Device 10 may be used with multiple types of carrying cases. For example, device 10 may be used with a golf bag, as shown in FIG. 6, or with a purse, as shown in FIG. 7. For use with a golf bag, device 10 may be placed over a small handle of the golf bag, with side body portions 14 and 36 wrapping around the golf bag and being connected by straps 46 and 48. Alternatively, FIG. 6 shows one embodiment of the invention having aperture 12 of device 10 fitting over mounting device 90 on a golf bag. Mounting device 90 helps to keep device 10 in place and to prevent any slippage that may occur while the golf bag is being carried in conjunction with device 10. Side body portions 14 and 36 (not shown) wrap around the golf bag and are connected by straps 46 and 48 (not shown). Alternatively, a separate mounting attachment may fit into the mouth of the golf bag and extend partially down the side of the golf bag, providing a removable mounting attachment on which aperture 12 of device 10 may rest.

FIG. 8 shows an alternate embodiment of the storage device of the present invention that allows the device to be carried separately from the carrying case. Device 110 has attachments 96 and 98 located on attaching edges 64 and 65. Attaching edges 64 and 65 are located on opposing edges of base sheet 8 that border aperture 12. Attachments 96 and 98 are structures that couple device 110 to a carrying strap, such as a shoulder strap. Attachments 96 and 98 allow a carrying strap, preferably an adjustable shoulder strap, to be fastened to device 110, enabling device 110 to be carried separate from a carrying case.

The carrying strap may be any suitable material or shape, but is preferably a narrow strip or band of nylon, leather, canvas, or other material. The carrying strap is of the type commonly known in the art, but more specifically, the carrying strap has clips on its ends which secure it to attachments 96 and 98. In FIG. 8, attachments 96 and 98 are "D-rings." The clips at the ends of the carrying strap are hooked onto attachments 96 and 98, allowing device 110 to be carried separate from a carrying case.

FIG. 8 also shows an embodiment of device 110, featuring compartment 102 designed to store and transport an umbrella. Although FIG. 8 shows compartment 102 in conjunction with an embodiment of the invention that is designed to store and carry shoes, compartment 102 may also be present on other embodiments of the invention described above.

In this embodiment, one or more of compartment pockets 104 may have an expandable opening that is comprised of a cord or similar article that is embedded into the pocket edges surrounding opening 22, which when pulled or secured, closes opening 22. Compartment pockets 104 may also be at least partially hidden from view by a sheet of material, as described above.

Based on the features described above, the storage device of this invention provides a convenient, practical way to store and carry items that may be difficult to otherwise transport. Travelers and commuters who already carry a briefcase, suitcase, purse, or other carrying case may use the storage device to save space, carry items more easily, and free their hands, while also protecting the items contained therein. Those who desire to carry the storage device alone and not in conjunction with a carrying case may also do so, by fastening a strap to attachments 96 and 98 located on the edges of the device. The examples of shoes, baby accessories, newspapers, books, maps, reading material, umbrellas, keys, cellular phones, organizers, hand-held computers, bottled water, and other personal items are merely examples of items that may be stored and transported with the invention. The particular embodiments of the invention having been described above are not limiting of the present invention, and those of skill in the art can readily determine that additional embodiments and features of the invention are within the scope of the appended claims and equivalents thereto.

What is claimed is:

1. A storage device for use with a carrying case, comprising:

(a) a first body portion having at least two compartments;

(b) a second body portion having at least one component;

(c) a connecting portion between the first body portion and the second body portion and having an aperture therein adapted to receive a handle of a carrying case; and (d) at least one removable bag, wherein the at least one removable bag is attached using an attachment component.

2. The device according to claim 1, wherein the at least one removable bag is attached to the device on or near an edge that is adjacent to the aperture.

3. The device according to claim 2, further comprising an additional removable bag, wherein each removable bag is located on or near an edge that is adjacent to the aperture.

4. The device according to claim 1, wherein the at least one removable bag is attached using an attachment component selected from the group consisting of zippers, hook-and-latch material, snaps, button and corresponding button hole, male and female connectors, magnetic strips, buckles, and D-rings.

5. The device according to claim 1, wherein the at least one removable bag is attached to one of the first and second body portions.

6. The device according to claim 5, further comprising an additional removable bag.

7. A storage device for use with a carrying case, comprising:

a continuous base sheet comprising, (a) a first body portion having at least two compartments;

(b) a second body portion having at least one compartment; the first body portion adapted to lie alongside one side of a carrying case and the second body portion adapted to lie alongside an opposite side of the carrying case;

(c) a section between the first body portion and the second body portion having an aperture therein adapted to receive a handle of a carrying case, wherein the at least two compartments of the first body portion have a length that is parallel to the aperture so that the compartments lie substantially horizontally when the storage device is being carried; and (d) at least one removable bag attached using an attachment component.

8. The device according to claim 7, wherein the at least one removable bag is attached using an attachment component selected from the group consisting of zippers, hook-and-latch material, snaps, button and corresponding button hole, male and female connectors, magnetic strips, buckles, and D-rings.

* * * * *